United States Patent [19]

Alexandrov et al.

[11] 4,004,970

[45] Jan. 25, 1977

[54] RADIATION SOURCE FOR MOSSBAUER INVESTIGATIONS OF TELLURIUM COMPOUNDS AND METHOD OF PREPARING SAME

[76] Inventors: Anatoly Julianovich Alexandrov, ulitsa Butlerova, 10, kv. 112, Moscow; July Sergeevich Grushko, ulitsa Koli Podryadchikova, 16, kv. 40, Gatchina Leningradskoi oblasti; Evgeny Fredovich Makarov, Trubnikovsky pereulok, 11, kv. 3, Moscow; Konstantin Yakovlevich Mishin, ulitsa Kurgetova, 23, kv. 73, Gatchina Lenigradskoi oblasti; Daljus Antanas Jono Baltrunas, ulitsa Zhirmunu, 17, kv. 27, Vilnjus Litovskoi, all of U.S.S.R.

[22] Filed: Mar. 3, 1975

[21] Appl. No.: 554,705

[52] U.S. Cl. ..... 176/16; 250/493

[51] Int. Cl.[2] ..... G21E 1/10

[58] Field of Search ..... 176/10, 16; 250/493

[56] References Cited

OTHER PUBLICATIONS

NSA vol. 22, No. 15, Aug. 15, 1968, p. 3280, Abstract No. 31960.

NSA vol. 17, No. 23, Dec. 15, 1963 pp. 5254–5255, Abstract No. 39751.

*Primary Examiner*—Harvey E. Behrend

*Attorney, Agent, or Firm*—Holman & Stern

[57] ABSTRACT

A radiation source for Mossbauer investigations of tellurium compounds manufactured on the basis of $5MgO.Te^{124}O_3$.

Method of preparing this radiation source comprises irradiating $5MgO.Te^{124}O_3$ in a reactor by means of thermal neutrons, followed by annealing at a temperature ranging from 600 to 1,100° C for a period of from 5 to 10 hours.

2 Claims, No Drawings

RADIATION SOURCE FOR MOSSBAUER INVESTIGATIONS OF TELLURIUM COMPOUNDS AND METHOD OF PREPARING SAME

BACKGROUND OF THE INVENTION

The present invention relates to radiation sources adapted for Mossbauer investigations of chemical compounds and to methods of preparing such sources employed for investigating structures of chemical compounds, studying chemical transformations of organic and inorganic chemical compounds as well as for analytical applications and in industry.

More specifically, the present invention relates to a radiation source for Mossbauer investigations of tellurium compounds and to a method of preparing the source.

Known in the art are radiation sources for Mossbauer investigations of tellurium compounds such as the binary tellurium compounds $Zn^{67}Te^{125m}$ and $PbTe^{125m}$ and such sources as $Sb^{125}$ in Cu, $I^{125}$ and $\beta$-$Te^{125m}O_3$.

There are various methods of preparing such radiation sources. In the preparation of sources such as ZnTe and PbTe after the production of a chemical matrix from inactive compounds such as $Zn^{67}Te^{124}$ and $PbTe^{124}$, the matrix is exposed to irradiation in a reactor by means of thermal neutrons, whereafter, to eliminate radiation defects, the matrix is annealed at a temperature within the range of about 400° to 500° C for a period of from 1 to 3 hours.

Sources made of $Sb^{125}$, $I^{125}$ and $\beta$-$Te^{125m}O_3$ require preirradiation, of an isotopic raw material in a reactor, followed by special radio-chemical synthesis to obtain a required chemical form of the source.

The prior art sources and the methods of preparing the sources feature some disadvantages, among which the most essential are the following:

1. Sources such as ZnTe, PbTe and $Sb^{125}$ in Cu have but a small probability of Mossbauer effect which, even at the temperature of liquid nitrogen, does not exceed 0.2 and at room temperature is at most 0.05. Furthermore, these sources have, as a rule, a widened emission line as compared to the natural one ($2\Gamma_n = 5.3$ mm/sec) which is due to difficulties of obtaining a strict stoichiometric composition of these compounds as a chemical form of the sources.

Sources using $I^{125}$ also have a small probability of Mossbauer effect and may be used only in emission spectroscopy.

2. The Source $\beta$-$TeO_3$, though having good Mossbauer parameters, is difficult to prepare. To produce it, one should perform a complex radio-chemical synthesis of an unstable compound, viz. $\beta$-$TeO_3$ which already at a temperature of about 100° C is transformed into other modifications, whereby the effect becomes less pronounced and the emission line is widened. Moreover, to prepare this compound, conditions of a specialized radio-chemical laboratory are necessary.

SUMMARY OF THE INVENTION

It is an object of the present invention to provide a radiation source of Mossbauer investigations of tellurium compounds with a high probability of Mossbauer effect and a natural width of the emission line and to provide a method of preparing the source which is simple and reliable as well as available for use in any non-specialized laboratory.

This object is accomplished in that the radiation source for Mossbauer investigations of tellurium compounds is prepared, in accordance with the present invention, on the basis of a chemical compound of tellurium, viz. $5MgO{\cdot}Te^{124}O_3.3$.

The object of the present invention is also accomplished in that in the process of preparing the radiation source by way of irradiating a chemical compound of tellurium in a reactor by means of thermal neutrons, followed by annealing this compound, according to the present invention as the chemical compound of tellurium use is made of $5MgO{\cdot}Te^{124}O_3$ and annealing is performed at a temperature within the range of from 600 to 1,100° C for a period of from 5 to 10 hours.

It is preferred, however, to perform the annealing at a temperature within the range of from 900° to 1,000° C for 6 hours.

The radiation source for Mossbauer investigations of tellurium compounds prepared in accordance with the present invention on the basis of $5MgO{\cdot}Te^{124}O_3$ has a high probability of Mossbauer effect equal to 0.20 at room temperature and 0.51 at the temperature of liquid nitrogen; therewith, it has a natural width of the emission line. The method of preparing this radiation source according to the present invention is readily accessible for practically any laboratory and, which is most important, does not require a radio-chemical synthesis under specialized conditions. For this purpose, it is necessary to prepare, once, a stable nonradioactive compound $5MgO{\cdot}Te^{124}O_3$ in the required amount and to irradiate the compound in the reactor as necessary.

DETAILED DESCRIPTION OF THE PREFERRED EMBODIMENTS

Given hereinafter is a description of the preferred embodiment of the method of preparing a radiation source for Mossbauer investigations of tellurium compounds based on $5MgO{\cdot}Te^{124}O_3$. The latter compound in a powder-like form is placed into a quartz ampule to be irradiated in a reactor. The flux of thermal neutrons and the irradiation time depend on a desirable source activity. It is advisable that the source activity be within the range of from 10 mC to 10 C at a flux of thermal neutrons of from $10^{13}$ to $10^{15}$ thermal neutrons/cm$^2$.sec, while the irradiation time per se is varied from 10 hours to 1,000 hours. In doing so, a radioactive compound of $5MgO{\cdot}Te^{125m}O_3$ is produced. After irradiation, the radioactive compound $5MgO{\cdot}Te^{125m}O_3$ is annealed at a temperature within the range of from 600° to 1,100° C for a period of from 5 to 10 hours and then gradually cooled to room temperature. The annealed finely-divided power of $5MgO{\cdot}Te^{125m}O_3$ is uniformly distributed over the surface of a substrate using an adhesive such as BF-2 as a binder and coated with an aluminium foil on a cement. At this stage the procedure of making a radiation source is finished.

A method of preparing the above-mentioned compound $5MgO{\cdot}Te^{124}O_3$, if it is not available, contemplates a simple chemical synthesis. As the starting material therefore use is made of a stable isotope $Te^{124}$ (with a high enrichment of $Te^{124}$, i.e. about 90% and above). The synthesis is effected in the following manner:

$$Te^{124}+3_2O_2+5MgSO_4+10\ KOH \quad MgO{\cdot}Te^{124}O_3+5K_2SO_4+8H_20$$

$5MgO{\cdot}Te^{124}O_3$ in the form of a residue resulting from the reaction is dried at a temperature of from 120° to 140° C for 1 hour and then calcined for 2 hours at 1000° C. Thereafter the compound is ready to be irradiated in the reactor.

For a beter understanding of the present invention, the following are specific Examples illustrating the method of preparing the radiation source according to the invention.

EXAMPLE 1

A weighed portion of 165 mg of ground $Te^{124}$ was placed into a 100 ml beaker and mixed with 3 ml of a 5N solution of KOH. The mixture was heated to a temperature of 60° to 70° C and a 30% solution of $H_2O_2$ was added thereto under stirring. Therewith, an intensive oxidation of the tellurium occurred with the formation of $K_2H_4TeO_6$ which is completed after 10–15 minutes; the excess of hydrogen peroxide is then decomposed by heating at reflux. The potassium tellurate solution was diluted with distilled water to 50 ml and gradually mixed with a solution of 1.63 g of magnesium sulphate ($MgSO_4{\cdot}7H_2O$) in 30 ml of water. In doing so, a mixture of magnesium tellurate with magnesium hydroxide was precipiated. To minimize the adsorption of impurities and enlargening of the precipitate particles, the mixture was boiled, right after precipitation, for 10–15 minutes and the residue, without allowing the mixture to be cooled, was separated on a dense paper filter under suction. The residue was washed with several portions of hot water till no $SO_4^{=}$ ions were detected. Then, the residue was washed with 10 ml of absolute ethanol and 40–50 ml of diethyl ether, whereafter air was purged therethrough for 5–10 minutes. The residue was dried at a temperature of from 120° to 140° C, placed into a corundum crucible and calcined for 2 hours at a temperature within the range of from 900° to 1,000°c. The calcined residue of $5MgO{\cdot}Te^{124}O_3$ was ground, sealed into a quartz ampule and irradiated for 360 hours in a reactor with a flux of 3 to $10^{13}$ thermal neutrons/cm$^2$ sec. The resulting $5MgO{\cdot}Te^{125m}O_3$ was annealed at a temperature within the range of from 900° to 1,000°C for 6 hours, whereafter it was gradually cooled to room temperature.

As a result, a radiation source was obtained with an activity of 100 mC and with a natural width of the emission line.

EXAMPLE 2

A weighed portion of 500 mg of ground $Te^{124}$ was taken for the experiment. Further operations were performed in accordance with the procedure of Example 1, excluding the manufacture of the source $5MgO{\cdot}Te^{125m}O_3$ per se. To this end, a weighed portion of 100 mg. of $5MgO{\cdot}Te^{124}O_3$ was placed into a quartz ampule. Irradiation was effected in the reactor with a flux of thermal neutrons of $8.10^4$ thermal neutrons/cm$^2$ sec for 500 hours. Annealing of the resulting $5MgO{\cdot}Te^{125m}O_3$ was conducted at a temperature of 800°C for 7 hours. Further operations were similar to those of Example 1.

Two sources were prepared from the thus-prepared active compound: the former with an activity of 1C for experiments of nuclear coherent dissipation on tellurium single crystals and the latter with an activity of 200 mC for experiments on resonance absorption.

EXAMPLE 3

The experiments in this Example were performed in accordance with the procedure of Example 1, with the only difference that annealing of $5MgO{\cdot}Te^{125m}O_3$ was conducted at a temperature of 600° C for 10 hours.

As a result, a radiation source was obtained with an activity of 100 mC and with a width of the emission line slightly more than the natural one: $2\Gamma = 6$ mm/sec.

What is claimed is:

1. A method of preparing a radiation source for Mossbauer investigations of tellurium compounds comprising the steps of: irradiating $5MgO{\cdot}Te^{124}O_3$ with thermal neutrons in a reactor to obtain $5MgO{\cdot}Te^{125m}O_3$; annealing the $5MgO{\cdot}Te^{125m}O_3$ at a temperature ranging from 600° to 1,100°C for a period of from 5 to 10 hours; and then gradually cooling the annealed $5MgO{\cdot}Te^{125m}O_3$ to room temperature.

2. The method of preparing a radiation source as claimed in claim 1, wherein the annealing step is effected at a temperature ranging from 900° to 1,000° C for 6 hours.

* * * * *